US005222888A

United States Patent [19]

Jones et al.

[11] Patent Number: 5,222,888

[45] Date of Patent: Jun. 29, 1993

[54] ADVANCED PROOF-OF-ROTATION SWITCH

[75] Inventors: Robert E. Jones, St. Charles County; S. Duke Snider, St. Louis County, both of Mo.

[73] Assignee: Emerson Electric Co., St. Louis, Mo.

[21] Appl. No.: 748,287

[22] Filed: Aug. 21, 1991

[51] Int. Cl.[5] ..... F23N 3/00

[52] U.S. Cl. ..... 431/20; 431/12; 431/18

[58] Field of Search ..... 431/12, 18, 20, 24, 431/90; 415/30, 118; 126/116 A

[56] References Cited

U.S. PATENT DOCUMENTS

| | | | |
|---|---|---|---|
| 4,298,334 | 11/1981 | Clark et al. | 431/24 |
| 4,412,328 | 10/1983 | Homa | 431/24 X |
| 4,421,268 | 12/1983 | Bassett et al. | 431/20 X |
| 4,752,210 | 6/1988 | Trent | 431/20 |
| 5,076,780 | 12/1991 | Erdman | 431/24 |

FOREIGN PATENT DOCUMENTS

| | | | |
|---|---|---|---|
| 0162236 | 12/1979 | Japan | 431/20 |

*Primary Examiner*—Carl D. Price

*Attorney, Agent, or Firm*—Polster, Lieder, Woodruff & Lucchesi

[57] ABSTRACT

A HVAC system (10) employs a gas valve (20) to supply gas for combustion within a heating portion (12) of the system. An exhaust (22) removes combustion products using a motor (28) driven exhaust fan (24). An apparatus (34) controls combustion and uses a sensor (36) for sensing the rotational speed of a motor shaft (26). A switch (T1) is responsive to sensed motor speed to open and close the valve, the valve being opened only if the motor is operating within a predetermined speed range. A first speed discriminator (48A) enables of the switch to open the valve when the motor speed exceeds a first predetermined value. A second speed discriminator (48B) disables the switch to close the valve when motor speed exceeds a second and higher predetermined speed which is indicative of a blocked exhaust, or a fan blade is loose. This latter action insures that a build-up of potentially dangerous exhaust gases cannot occur.

14 Claims, 4 Drawing Sheets

ADVANCED PROOF-OF-ROTATION SWITCH

BACKGROUND OF THE INVENTION

This invention relates to heating, ventilation, air conditioning (HVAC) systems and, more particularly, to apparatus for controlling operation of the portion of a system as a function of whether or not an adequate draft is induced in the exhaust so combustion products are discharged from the system.

In conventional HVAC systems, gas is supplied to a furnace portion of the system through a switch controlled valve. The gas is combusted to heat air which is then circulated through the system. The products of combustion, carbon monoxide, etc., are exhausted through a flue or exhaust duct. For this purpose, a draft is induced in the flue or duct by a motor driven fan. The resultant air flow draws off the combustion products from the chamber to the flue. Because the exhaust gases are potentially dangerous, it is important to know if they are, in fact, being exhausted.

There are a number of reasons why they may not be. Among these are a fan motor which is not functioning, a blower fan which is loose, a blocked exhaust flue or duct, etc. Operationally, the HVAC system is controlled so that the gas valve is opened only when a sufficient flow of air is induced in the exhaust. If it is ascertained that combustion gases cannot be properly exhausted, for any of the above reasons, then the valve is not opened.

Various techniques exist for determining if a sufficient air flow is being produced. For example, it is known to monitor the rotational speed of an exhaust motor shaft on which an exhaust fan is installed to insure that the motor is rotating above some predetermined speed. If it is, the gas valve can be opened; otherwise, not. This monitoring device is typically a centrifugal switch which closes when the motor speed exceeds some minimum value, and opens when the speed drops below that level. Such devices have a number of drawbacks. While do they monitor shaft speed, they cannot determine if a fan blade is loose and therefore not able to move a volume of gas. They cannot tell if there is flue blockage. It is possible to employ other devices to monitor for these potential problems. Thus, a pressure sensor installed in the flue could sense a blockage condition. Or, air flow sensors could be used to ascertain flow levels toward the exhaust. However, employing more sensors has an impact in a number of areas. More parts have to be installed, calibrated and adjusted, increasing set-up time. More parts are involved increasing inventory costs. With more parts, the reliability of the system decreases and a certain amount of redundancy may have to be built into the system so that its operating life is maintained. Again, this adds to system cost.

It would be advantageous to have available a single sensor to monitor all these different potential areas of failure; especially, a sensing mechanism whose cost is comparable to that of existing low cost sensors and substantially less than that of other sensors which would otherwise be used.

SUMMARY OF THE INVENTION

Among the several objects of the present invention may be noted the provision of apparatus for use in a HVAC system for controlling the heating operation of the system; the provision of such apparatus for monitoring the exhaust portion of the heating system to insure an adequate air flow is induced in the exhaust, and for allowing combustion to occur only so long as this adequate level is maintained; the provision of such apparatus to employ a simple sensing mechanism to quickly and accurately sense whether or not an adequate air flow is established and maintained; the provision of such a sensing mechanism which does not contact the motor, has a small power drain, is small in size, highly sensitive, and can withstand exposure to dust and other contaminants without deleterious effect on its performance; the provision of such apparatus to allow for hysteresis effects as part of cycling off the heating system; the provision of such apparatus to operate of the same power as required by a thermostat for the heating system; the provision of such apparatus to monitor operation of the sensing mechanism and take appropriate action if the mechanism fails; the provision of such apparatus to be short circuit protected in the event the apparatus is miswired into a HVAC system, or if the gas valve which it controls is subject to an electrical short; the provision of such apparatus to interface with a microprocessor controller for the HVAC system; and, the provision of such apparatus which requires few components, thus to simplify design, lower apparatus cost and reduce inventory, yet which provides a better level of control than currently available systems.

In accordance with the invention, generally stated, a HVAC system employs a gas valve for supplying a gas for combustion within a heating portion of the system. An exhaust removes the products of combustion from the system and a motor driven exhaust fan induces an air flow within the exhaust by which combustion products are directed to the exhaust. An apparatus of the invention controls system operation and utilizes a sensor for sensing if a motor output shaft is rotating and, if so, the shaft's rotational speed. A switch is responsive to the sensed motor speed for opening and closing the valve. The valve is opened only if the output shaft of the motor is sensed to be rotating within a predetermined speed range. A first speed discriminator effects enabling of the switch so long as the motor speed is above a first predetermined value. A second speed discriminator effects disabling of the switch to close the valve if the shaft rotational speed exceeds a second predetermined speed which is indicative of a blocked exhaust, or that a blade of the fan is loose. This second controller therefore acts to insure that a build-up of potentially dangerous exhaust gases does not occur.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 1:
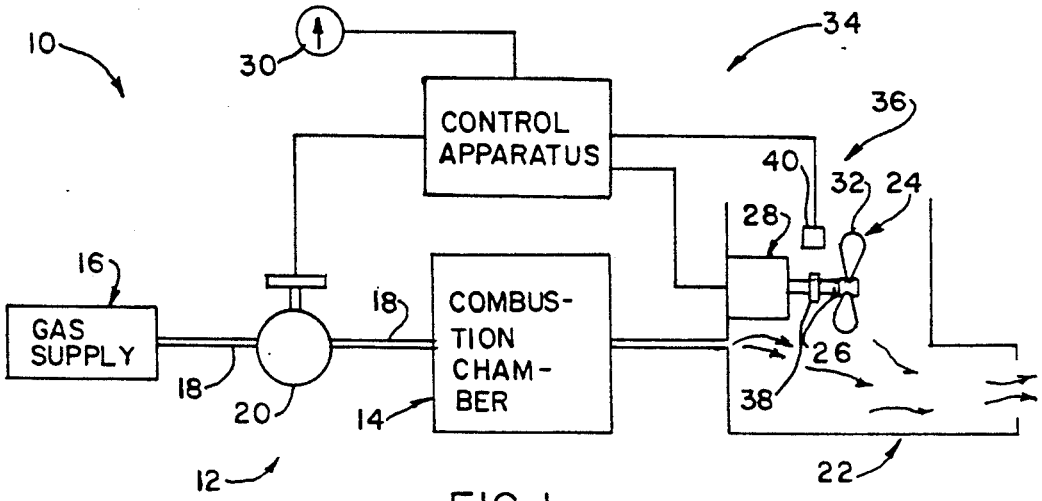
FIG. 1 is a block diagram of a heating portion of a HVAC system with which the apparatus of the present invention is used.

Referring to the drawings, a HVAC system 10 has a heating section 12. This section includes a combustion chamber 14 to which gas is supplied from a source 16 through a gas line 18. A valve 20 interposed in the line is openable and closeable to permit flow of gas to the chamber under operating conditions as are described hereinafter. When ignited in the combustion chamber, the gas heats air which is then circulated throughout the building, home, etc., all as is well understood in the art. The resultant products of combustion also include certain noxious gases which must be removed from the system for safety reasons. For this purpose, heating section 12 includes an exhaust 22. A fan 24 is mounted on the shaft 26 of a motor 28. When energized, the motor driven fan induces an air flow in the exhaust, this flow of air pulling the combustion products away from chamber 14 and out the exhaust.

In order to effectively remove the combustion products, it is necessary that the motor and fan develop sufficient pressure so that a sufficient air flow is induced within the exhaust. Otherwise, a build-up of gaseous products within the system may occur, and the levels of this material could quickly become dangerous. One strategy employed in HVAC systems to insure proper operation is to start the fan motor prior to opening the gas valve. The motor is then monitored to insure that it is operating at a speed sufficient for the fan to induce an adequate air flow. Once the motor speed exceeds this minimum revolutions per minute (rpm), the gas valve 20 is opened. If thereafter, the sensed motor speed falls below the level minimum rpm, the valve is closed. Additionally, if the motor speed never rises above the minimum level, the valve is never initially opened.

Figure 2:
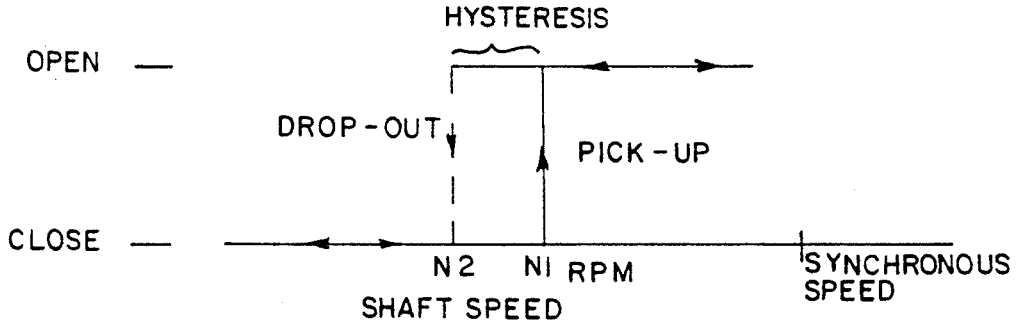
FIG. 2. PRIOR ART.
FIG. 2 is a simplified flow chart illustrating the operation of a motor in a conventional prior art HVAC system.

Referring to FIG. 2, implementation of the above described operation is graphically depicted. As shown, valve 20 is closed at motor start-up. The valve remains closed while the motor speed increases to a value N1. As the motor's rpm's increase past this value, the valve is opened. Thereafter, when the motor speed decreases to a value N2, the valve is closed. Value N2 is a lower speed than value N1 to compensate for the hysteresis inherent in the system. It will be understood that the length of time the valve remains open is a function primarily of motor speed. The heating section of the HVAC system may, for example, include a thermostat 30 which monitors the temperature in the heated environment. If the thermostat indicates the temperature has warmed to a preselected value, the section will shut down. This could include closing valve 20 prior to shutting off motor 28. Or, the motor could remain running, although at a lower speed.

Various speed sensors are well-known in the art which could be used with a motor 28 to monitor its speed. For example, centrifugal switches are available which can be attached to the motor's shaft. These switches close when the minimum speed is exceeded, and open when the speed subsequently falls back below the minimum. With respect to FIG. 1, it will be understood that adequate air flow through the exhaust is dependent upon more than just the rotor speed of motor 28. If, for example a blade 32 of the fan were loose, the fan's efficiency in moving air is greatly reduced and although the rotor speed may be adequate, the air flow rate may be less than is necessary to prevent a build-up of combustion products in the exhaust. Similarly, if the exhaust were partially or completely blocked, the air flow rate would be inadequate, but this would not be sensed by a centrifugal-type sensor. Pressure transducers or air flow detection devices could be employed for these latter purposes, but these add considerable expense to the system.

Figure 7:
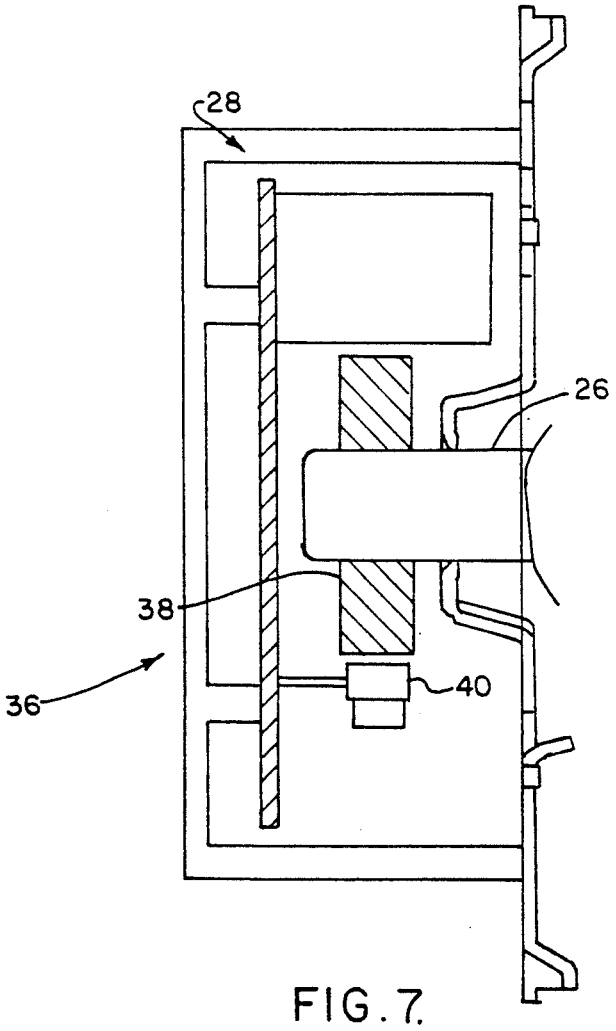
FIG. 7 is a sectional view of one end of the motor illustrating the mounting of a sensing mechanism of the apparatus.
Figure 6:
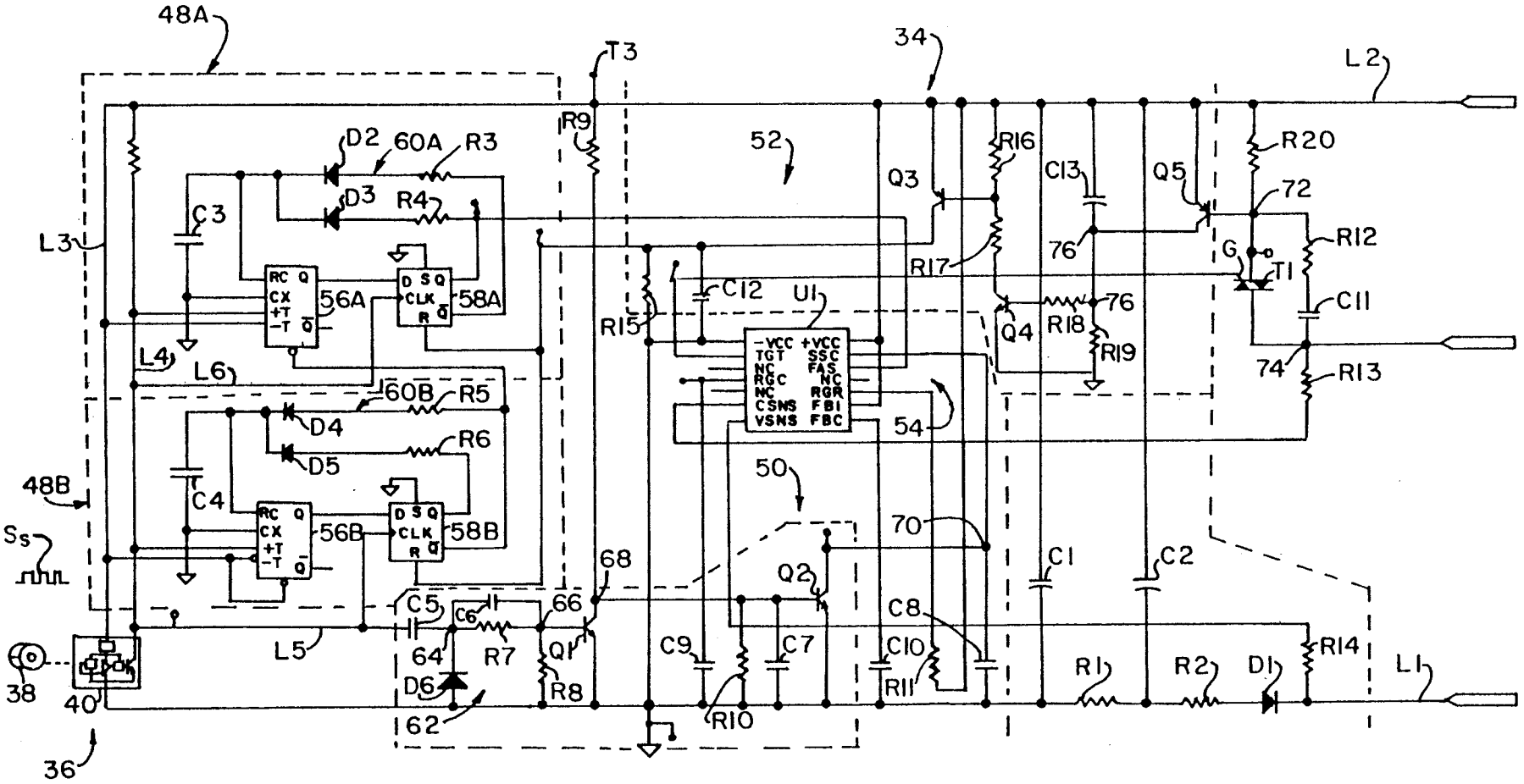
FIG. 6 is a schematic diagram of the circuit.

The apparatus of the present invention is indicated generally 34 and first includes means 36 for sensing if the motor 28 output shaft 26 is rotating and, if so, at what speed. Referring to FIG. 7, means 36 includes, in turn, a ring shaped magnet 38 installed on shaft 26, and a Hall effect sensor or switch 40 positioned adjacent the ring. Sensor 40 is a solid-state sensor which senses the changes in polarity of the ring magnet and is responsive to these transitions to generate a pulse stream S, as shown in FIG. 6. The frequency of the pulses is a function of the number of magnetic poles in the ring, and the speed at which the shaft is rotating. Alternatively, means 36 could include means to monitor the motor's back electro-motive force (BEMF) as an indirect measure of motor shaft speed.

Figure 5:
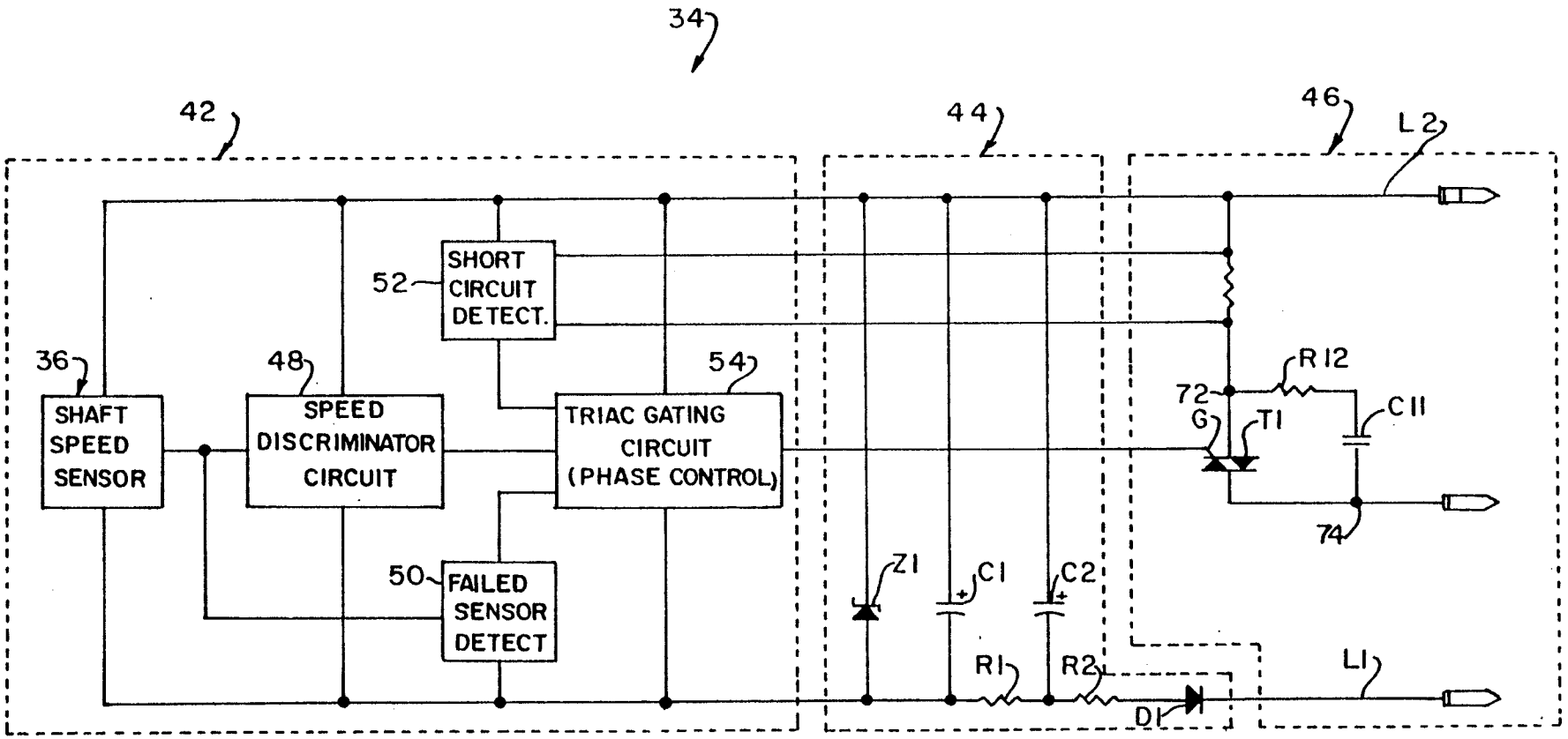
FIG. 5 is a block diagram of a proof-of-rotation switch circuit of the present invention.

Referring to FIG. 5, a block diagram of the apparatus indicates that means 36 comprises a portion of a control logic module 42 of the apparatus. A second module 44 is a power supply module; and, a third module 46 is a switching module for effecting opening and closure of the gas valve 20. Module 44 is designed for use with commonly available commercial and residential control systems for thermostat 30. The circuit operates off of a 24VAC (+/−6VAC) transformer (not shown). To operate the control logic module, the input voltage is first half-wave rectified by a diode D1, and filtered by a two-pole RC filter comprising capacitors C1, C2 respectively, and resistors R1, R2. The resultant rectified voltage is shunt regulated by a zener diode Z1. In FIG. 6, this zener diode is an internal component of an integrated circuit phase control chip U1. In operation, capacitor C2 supplies the average power required by module 42, and capacitor C1 an AC ripple current required when a triac T1 of switch module 46 is gated on. If the lower rail L1 shown in FIG. 5 is a reference, the voltage at upper rail L2 is, for example, +8.6 volts.

With respect to the control logic module, the output of means 36 is supplied to both a speed discriminator circuit 48 and to a failed sensor detector 50. These elements will be described in more detail hereinafter. The respective outputs of circuit 48 and detector 50, together with the output of a short circuit detector 52, are supplied to a triac gating circuit 54. Circuit 54 controls the switching of triac T1 of switch module 46. The triac switches valve 20 open and closed in response to the signal it receives from circuit 54.

Referring now to FIG. 6, the pulse output from Hall effect sensor 40 is indicated $S_s$ and is a square-wave clock pulse having an approximately 50% duty cycle. As noted, the frequency of the pulses is a function of motor speed and, in general, as the speed of the motor increases, the frequency of the clock pulses also increases, so that the period between each clock pulse decreases. The frequency of signal $S_s$ is given by the formula $$F_H = N^*P/120$$

where:

$F_H$ is the output frequency in Hz,

N is the motor speed in RPM, and

P is the number of poles on ring magnet 38.

The pulses comprising clock signal $S_s$ are supplied on signal line L4 to the input of respective speed discriminator circuits 48A and 48B of speed discriminator 48. Each discriminator is essentially identical in configuration comprising a monostable multivibrator 56A, 56B respectively. The clock pulses are provided to the positive edge triggered clock inputs +T of each monostable. Each discriminator also includes a D-type flip-flop 58A, 58B and the clock pulses are provided to the clock inputs CLK of each flip-flop via lines L5 and L6 which extend off line L4. The Q output of each monostable provides a constant pulse width output pulse from its Q output to the D input of its associated flip-flop. In addition, the Q-NOT output of flip-flop 58B is connected to the reset port of monostable 56A. The width of the pulse is determined by respective RC time constant circuits 60A, 60B.

Figure 3:
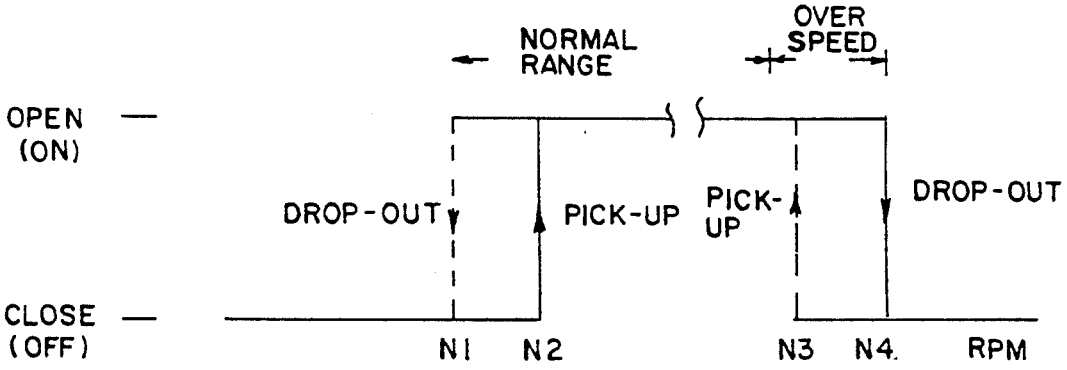
FIG. 3 is a flow chart similar to FIG. 2 but illustrating added operational features resulting from use of the present invention in the system.
Figure 4:
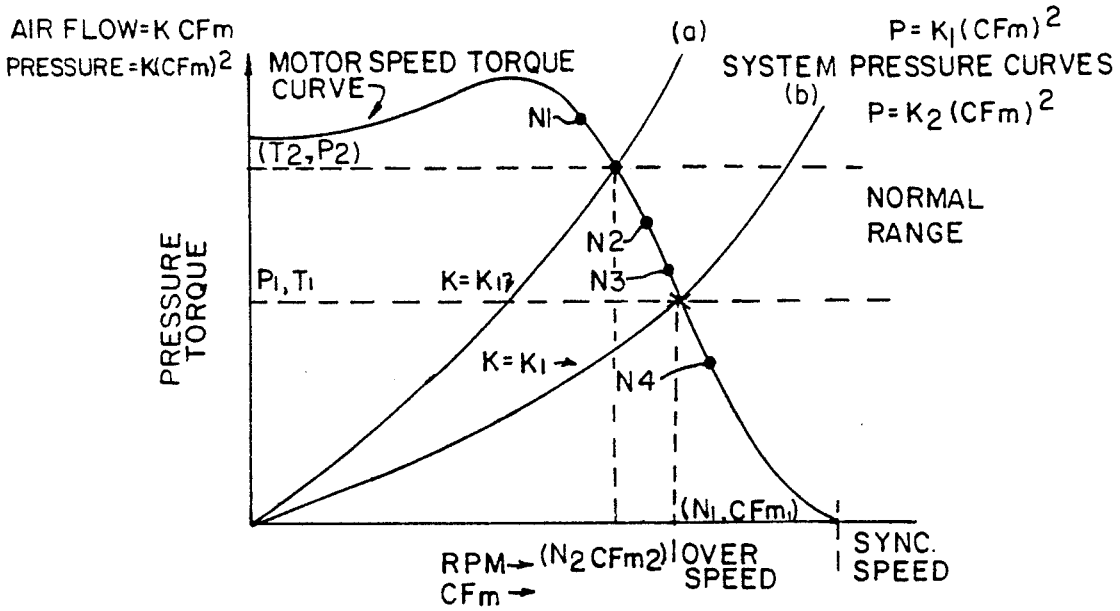
FIG. 4 is a graph of a torque vs. speed operating curve for the system overlaid on a typical draft inducer fan torque vs. speed characteristic curve.

In this regard, and with respect to FIGS. 3 and 4, it will be understood that in addition to the pick-up and drop-out points N1 and N2 previously discussed, the apparatus of the present invention also monitors an additional set of pick-up and drop-out points N3 and N4. These points are at the upper end of a predetermined speed range for the motor. The addition of these points is advantageous because it also allows the apparatus to monitor for a blocked or clogged exhaust condition, as well as the situation where a fan blade is loose, as well as the "proof-of-rotation" function provided by conventional sensors. In either of these additional instances, the speed of the motor will increase above a normal predetermined range of operating speeds. This upper set of switch points is designed to protect the home owner from potential harm. The harmful effects occur if combustion products (carbon monoxide, CO) are not removed from the exhaust because insufficient air flow is established. There is a critical relationship between pressure, airflow, motor speed and torque. This relationship is $$CFM\ KN$$

where

CFM is airflow in cubic ft. per minute,

K is a system constant determined by duct geometry, air density, etc., and N is motor speed in revolution per minute.

K does vary as the house duct system changes, as, for example, when a duct is opened and closed. K does remain constant, however, for a given operating point, air pressure P is proportional to $(CFM)^2$. Thus, $$P\ K_1\ (CFM)^2 = K_1\ (K_{CFM}\ N)^2$$

Referring to FIG. 4, system pressure curves a and b represent normal changes in K over the operating range of a HVAC system. As the motor and fan rotate, pressure builds up in the ducting of the exhaust. For a given $K_{CFM}$, $K_P$, the juncture of the motor/torque curve and a system pressure curve defines a given system operating point. Pressure thus represents a load or retarding torque as seen at the motor shaft. Equilibrium occurs when motor torque equals system pressure for a given speed and air flow.

If a flue is blocked, or an impeller is loose, the retarding pressure is greatly reduced. This unloads the motor. Motor torque is thus greater than the retarding torque and the motor is driven to its no-load or synchronous speed. This speed is a higher rpm than the motor normally operates at, and the motor can run indefinitely at this speed. As a practical matter, the maximum speed is limited by the line frequency and motor pole count. This speed is normally 3600 or 1800 rpm based on motor design.

If there is no pressure, $K_P$ and $K_{CFM}$ fall to zero, and P, CFM, and airflow are also zero. Under these conditions, no combustion products are removed, but rather can build up to dangerous levels. As previously discussed, it is possible to monitor for these further conditions using conventional sensors. However, these additional components are an increased system cost. In apparatus 10, on the other hand, a single sensing means is capable of monitoring for all three conditions. This makes for a simpler, and cheaper, system design.

In the circuit of FIG. 6, discriminator 48A detects the pick-up and drop-out points N1 and N2, and discriminator 48B the pick-up and drop-out points N3 and N4. Since each discriminator is responsible for two points, each discriminator has two distinct timing circuits. Circuit 60A includes a capacitor C3 which is connected in series with diode D2 and resistor R3, and also with series connected diode D3 and resistor R4. Resistor R4 is connected to the Q output of flip-flop 58A, and resistor R3 to the Q-NOT output thereof. In circuit 60B, a capacitor C4 which is connected in series with diode D4 and resistor R6, and also in series with diode D5 and resistor R6. Resistor R5 is connected to the Q output of flip-flop 58B, and resistor R5 to the Q-NOT output thereof. If the Q output of either flip-flop is high, the respective diode D2 or D4 is biased "on" and the RC time constant is determined by the respective combinations of **C3*R3, or C4*R5. Conversely, if the Q-NOT output of the flip-flops is high, diodes D3 or D5 are biased "on" and the RC time constant is determined by C3*R4, or C4*R6 respectively. It will be understood that while the values of capacitors C3 and C4 may be the same, the value of each resistor R3-R6** is different.

Upon power-up of the apparatus, both of the monostables and the flip-flops are cleared. In this condition the Q-NOT output of both flip-flops is such that diodes D2 and D4 conduct and the time constant of the respective discriminators is set by **C3*R3, and C4*R6. When motor 28 begins to accelerate and shaft 26 speeds up, Hall effect switch 40 begins generating clock pulses $S_s$. On the leading, or positive, edge of each clock pulse, each monostable generates a fixed pulse width output pulse whose pulse width is determined by the respective RC time constants C3*R3, and C4*R5. If the width of the monostable's output pulse is less than the period of the clock pulses from the Hall effect switch, the inputs to the flip-flops will return to their low state prior to the next positive trigger of the monostable. The Q output of the flip-flops will remain in their reset state. This condition will persist so long as the motor speed remains below N1**.

As the motor speed continues to increase, the period of the clock pulses diminish When the motor reaches the speed N1, the pulse width of the output from monostable 56A to flip-flop 58A will exceed the clock pulse width. Flip-flop 58A is now set. The set output of the flip-flop is a logic "high" and is connected to an enable input FAS of integrated circuit chip U1. This chip is included in the triac gating circuit 54. When the FAS input of the chip goes "high", a gating signal is directed from output TGT of the chip to the gate input of triac TI. This, in turn, activates gas valve 20 which is, for example, a solenoid valve.

Because the triac is a bi-directional ac semiconductor switching device, once latched by the application of an appropriate signal to its gate input G, the signal can be removed so long as the current through the device exceeds a critical holding current level. Consequently, the device does not turn "off" until its load current falls off to zero. In apparatus 34 of the present invention, the pulse applied to gate G is an approximately 10 microsecond pulse and is accurately placed at the zero current crossing point as defined by the operational characteristics of the triac used. As a result, the average power requirement of circuit 54 is relatively small. This allows use of the half-wave power supply module 44 rather than a module having to provide much higher power levels. Further, this allows the components used within the power supply module to smaller in size than if another type of power supply module were needed. In this apparatus, the voltage and current to which it is subjected is approximately 30V. and 0.3a.

For the above, the RC time constant defined by C3*R3 corresponds to the lower pick-up speed N1. After flip-flop 58A is set, diode D3 conducts and the time constant for discriminator is now set by C3*R4. Because R4 R3, the next pulse generated by monostable 56A will have a longer pulse width than previously. To clear flip-flop 56A, and close gas valve 20, the speed of shaft 26 must decrease. Consequently, the time constant defined by C3*R4 corresponds to the lower drop-out speed N2. Further, (R4-R3)*C3 is proportional to the width of the hysteresis band associated with this lower speed set of pick-up and drop-out points After point N1 is passed, the shaft speed will continue to increase until an equilibrium speed is attained. This speed is a function of the requirements of the load presented by the HVAC system. Thereafter, so long as the fan or impeller blades remain tight, the exhaust remains clear of obstruction, and power is applied to motor 28, the system will remain operating with valve 20 open.

If during operation of the system, the exhaust becomes clogged, or a fan blade does become loose, the load on motor 28 will be greatly reduced. The motor's speed will then greatly increase, the motor trying to reach its no-load or synchronous speed. If the shaft speed reaches the point where it exceeds predetermined speed point N4, the width of the output pulse from monostable 56B will exceed that of the clock pulse from the Hall effect switch. Now, flip-flop 58B will be set. Because the reset input of monostable 56A is connected to the Q-NOT output of flip-flop 58B, when flip-flop 58B is set, a reset signal is applied to monostable 56A. On the clock pulse, flip-flop 58A is reset since the Q output of monostable 56A is connected to the D input of this flip-flop. Resetting of flip-flop 58A removes the logic "high" at the FAS input of chip U1, thus disabling triac T1. Gas valve 20 is now closed. In addition, setting of flip-flop 58B switches the time constant for discriminator 48B from C4*R5 to C4*R6. Because R6 R5, the speed of the motor must decrease in order for the valve to be re-opened. Consequently, C4*R5 corresponds to the upper drop-out speed N4, and C4*R6 to the upper pick-up speed N3. This time, (R6-R5)*C3 represents the hysteresis band. If the speed of the motor were to subsequently decrease, for example, if the blockage to the exhaust were removed, the resultant decrease in motor speed past point N3 would cause the valve to be reopened in the manner previously described.

Apparatus 34 is also responsive to a failure of sensing means 36. This insures that the gas valve is not inadvertently opened when a motor or exhaust condition exists which cannot be sensed but which is unsuitable for combustion to take place. For this purpose, the apparatus includes the sensor failure detection circuit 50. This circuit is sensitive to the edges of the pulses comprising signal $S_s$ and acts to turn off valve 20 in the event means 36 fails in a latched "low" or latched "high" state with triac T1 still enabled to open the valve.

Circuit 50 first includes a pulse differentiator circuit 62 comprising capacitors C5 and C6, resistors R7 and R8, and diode D6. The clock pulses from Hall effect switch 40 on line L5 are impressed on capacitor C5 which is series connected in the line. Capacitor C6, is, in turn, connected to a junction 64. Also connected to this junction are capacitor C5, resistor R7, and diode D6. The diode is connected between node 64 and circuit common, while capacitor C6 and resistor R7 are connected in parallel between junction 64 and a junction 66. Resistor R8 connects between circuit common and junction 66. The base of a transistor Q1 is attached to node 66 and is therefore driven by the output of differentiator 62.

Because the differentiator circuit differentiates the incoming stream of clock pulses, transistor Q1 responds only to the positive edge transistions of this input. Consequently, if the clock pulse remain in either a "high" or "low" state, so no transitions occur, transistor Q1 will remain non-conductive. The output of the transistor is connected to a junction 68. Also connected to this junction are a capacitor C7, resistors R9 and R10, and the base of a transistor Q2. Capacitor C7 and resistor R10 extend in parallel between junction 68 and circuit common. Resistor R9 extends between the junction and line L2. These components form a RC timer circuit with transistor Q2. If transistor Q1 remains "off", the voltage applied to the base of transistor Q2 will rise until the transistor is switched into its "on" state. If transistor Q1 switches "on", which it should do under normal operating conditions, this will not occur, and transistor Q2 will remain "off" During normal operations, when transistor Q1 switches "on", a small amount of the charge built up by capacitor C7 is bled off. As a result, the voltage level developed across this capacitor, and impressed on the base of transistor Q2, is kept below the level required to switch transistor Q2 into conduction. With transistor Q2 in its non-conducting state, and with the FAS input of chip U1 "high" (the condition required for triac T1 to be enabled and valve 20 opened), a capacitor C8 will be charged.

As noted, if there are no transitions in the clock pulses provided to the differentiation circuit, transistor Q1 remains non-conductive. Now, sufficient charge is developed across capacitor C7 to turn transistor Q2 "on" When transistor Q2 switches "on", it provides a discharge path for capacitor C8 which is connected between a junction 70, to which the output of transistor Q2 is also connected, and circuit common. A soft-start port SSC of chip U1 is also connected to junction 70. Discharge of capacitor C8 changes the logic input at gate SSC and causes the chip to disable triac T1 and close valve 20. The function of circuit 50 as thus described is to shut off the gas valve independent of the operation of the discriminators 48A, 48B. The operation of circuit 50 is such that it operates at approximately 10 Hz. This is well below the pick-up and drop-out speeds associated with discriminator circuits 48A, 48B. Further with respect to operation of switch control circuit 54, a capacitor C9 is connected between circuit common and a port RGC of chip U1, and a capacitor C10 is connected between circuit common and a port FBC of the chip. A resistor R11 is connected between the line L2 and a port RGR of the chip. Capacitor C9 and resistor R11 comprise timing elements for a ramp oscillator internal to the chip. Capacitor C10 is a noise decoupling capacitor.

Within switch module 46, triac T1 is connected between junctions 72, 74. A resistor R12 and a capacitor C11 are connected in series with each other between these nodes so to be in parallel with the triac. These components form a snubber to prevent Dv/Dt turn-on of the triac which might otherwise be caused by noise on on the power lines L1, L2. A resistor R13 is connected between junction 74 and a port CSNS of chip U1. This resistor is used to sense the current crossing. A resistor R14 is connected between line L1 and a port VSNS of the chip. This resistor senses the line voltage zero crossing to provide line synchronization for the firing circuit.

Short circuit detection circuit 52 is designed to protect the apparatus in the event the gas valve is subject to an electrical failure. The circuit is also designed to protect the apparatus in the event it is miswired into a HVAC system during installation. The circuit first includes a resistor R15 and a capacitor C12 which are connected in parallel between circuit common and the reset inputs to flip-flops 58A, 58B. These components are also connected to the −Vcc input of chip U1. The reset inputs of the flip-flops are further connected to the collector of a PNP transistor Q3. The emitter of this transistor is connected to line L2. The base of the transistor is connected between a pair of resistors R16 and R17; resistor R16 also being connected to line L2, and resistor R17 to the collector of an NPN transistor Q4. The base of this transistor is connected to a junction 76 through a resistor R18. A capacitor C13 is connected between line L2 and this node; while, a resistor R19 is connected between the node and circuit common. The emitter of transistor Q4 is also attached to this ground point. Further, the collector of a PNP transistor Q5 connects to junction 76. The base of this latter transistor connects to junction 72, and its emitter is tied to line L2. Lastly, a resistor R20 connects between line L2 and junction 72.

When power is first applied to apparatus 34, capacitor C13 begins to charge. During the charging period, transistor Q4 is in conduction, and, in turn, switches transistor Q3 into conduction. Line L2 voltage is applied to the reset inputs of flip-flops 58A, 58B through the emitter-collector circuit of transistor Q3, resetting the flip-flops. This action drives the Q output of flip-flop 58A momentarily low, and this logic level is applied to the FAS input of chip U1. The chip output to gate G of triac T1 is now disrupted, rendering the triac non-conductive and insuring that gas valve 20 is closed.

When capacitor C13 is sufficiently charged, transistor Q4 is dropped out of conduction, taking transistor Q3 out of conduction as well. During the initial reset interval, the line L2 voltage was applied to capacitor C12, charging this capacitor. Now, the capacitor discharges through resistor R15. When the voltage represented by the charge on capacitor C12 falls below the reset threshhold of the flip-flops, the reset phase is complete and the discriminator circuits now function as previously described.

If, during subsequent functioning of the apparatus, the solenoid operating valve 20 is shorted out, the current through triac T1 will increase to the short circuit current capacity of the 24VAC transformer. This current level is approximately 13A., but decreases to 8a. within about 1 minute after the short circuit condition occurs. The short circuit current level is such that sufficient voltage is developed across resistor R20 to cause transistor Q5 to switch into conduction. Capacitor C13 now rapidly discharges and when the voltage level represented by the charge on the capacitor falls below the critical level, transistors Q3 and Q4 are again switched into conduction. The reset operation described above is repeated with triac T1 being switched out of conduction. When that happens, the voltage across resistor R20 falls to zero and transistor Q5 drops out of conduction. Capacitor C13 begins to recharge, subsequently taking transistors Q4 and Q3 out of conduction. The reset operation described above is repeated with triac T1 being switched out of conduction. When that happens, the voltage across resistor R20 falls to zero and transistor Q5 drops out of conduction. Capacitor C13 begins to recharge, subsequently taking transistors Q4 and Q3 out of conduction. It will be appreciated that the above described operation effectively isolates the apparatus from the short circuit condition.

After the short circuit condition is corrected, the apparatus is returned to normal operation. If the short circuit condition persists, the apparatus will keep cycling until the short is removed or the apparatus shutdown. The cycling time is a function of the time constants established by Capacitor C13 and resistors R18 and R19, and capacitor C12 and resistor R15. As a practical matter, the values of these components can be chosen such that the cycle time is on the order of, for example, 1.5–2.0 seconds. This cycle time is chosen to limit the transient and steady-state temperature effects of triac T1. Further, in addition to the earlier described attributes of the triac, it should also have a surge current rating which makes it capable of withstanding repetitive surge currents.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. Apparatus for controlling operations of a heating appliance employing an electrically controlled gas valve supplying a gas to be combusted within the appliance, the appliance having an exhaust system for removing combustion products and including a motor driven exhaust fan for inducing a draft within the exhaust system by which combustion products are exhausted from the appliance, the apparatus comprising:

means for sensing the rotational speed of the motor and for providing an output signal representative thereof, said motor operating over a range of rotational speeds;

switch means for opening and closing the gas valve as a function of motor speed; and, first and second speed responsive means for determining when the motor is operating within a predetermined range of speeds, said first speed responsive means determining when the motor exceeds a first predetermined speed, said second speed responsive means determining when the motor exceeds a second predetermined speed, said first speed responsive means opening the gas valve when the motor speed exceeds the first predetermined speed whereby the gas valve is open only when said motor speed is in a range between said first and second predetermined speeds, and operation of each of said first speed responsive means is controlled by said second speed responsive means, the first speed responsive means including first speed discrimination means for determining when the motor speed exceeds the first predetermined speed, and the second speed responsive means further includes second speed discrimination means for determining when the motor speed exceeds the second predetermined speed, each speed responsive means comprising a monostable multivibrator and a flip-flop, the sensing means providing an input clock pulse to each monostable multivibrator the pulse width of which is a function of motor speed, and the monostable multivibrator providing a fixed pulse width trigger pulse to its associated flip-flop to set the flip-flop, the flip-flop being reset so long as the width of a trigger pulse is less than that of the clock pulse provided by the sensing means, but being set when the pulse width of the trigger pulse exceeds that of the clock pulse, setting of the flip-flop indicating the motor speed has reached a predetermined speed.

2. The apparatus of claim 1 wherein the first and second speed responsive means further include means compensating for the hysteresis effects within the appliance thereby establish a band at each end of the motor speed range within which valve operation is controlled.

3. The apparatus of claim 2 further including means for monitoring operation of said sensing means and for closing said valve in the event of a sensing means failure.

4. The apparatus of claim 3 further including means responsive to a short circuit condition in said gas valve for isolating said apparatus from said gas valve, said short circuit responsive means resetting the apparatus upon power-up, and recycling the apparatus to perform its normal operations if the short circuit condition is corrected.

5. The apparatus of claim 3 wherein the sensing means provides an output signal comprising a stream of clock pulses and the monitoring means includes means for differentiating the clock pulses and providing an output which is a function of the sensed transitions in the clock pulses which occur so long as the sensing means is functioning but which do not occur if the sensing means has failed, and means responsive to the output of the differentiating means for providing a signal to the switch control means to disable the switch means when the output from the differentiating means indicates a sensing means failure.

6. The apparatus of claim 1 wherein the sensing means comprises a magnetic means installed on a motor shaft and rotatable therewith, and a Hall effect switch located in proximity to the magnetic means for detecting changes in polarity of the magnetic means as it rotates with the shaft.

7. The apparatus of claim 6 in which the Hall effect switch is a solid-state switch whose output is a clock pulse waveform whose frequency is a function of the motor's speed and the number of poles of the magnetic means.

8. The apparatus of claim 1 wherein each speed responsive means comprises a monostable multivibrator and a flip-flop, the sensing means providing input clock pulses to each monostable multivibrator and the monostable multivibrator providing trigger pulses to its associated flip-flop to set the flip-flop when the width of the trigger pulse exceeds that of the clock pulse indicating the motor speed has reached a predetermined speed, the switch control means being responsive to the setting of a flip-flop to enable the gas valve to be opened.

9. The apparatus of claim 8 wherein each speed responsive means further includes time constant means for establishing the pulse width of the output pulses supplied by the monostable multivibrator.

10. The apparatus of claim 9 wherein each time constant means establishes a pair of different time constants, one time constant for when the motor speed is less than the predetermined speed which the speed discrimination means monitors, and a second time constant for when the motor speed is greater, one time constant being used for one end of the hysteresis band, and the other time constant for the other end thereof.

11. The apparatus of claim 1 further including switch control means responsive to the first and second speed responsive means for enabling and disabling the switch means.

12. The apparatus of claim 17 wherein the switch control means is responsive to an output from the first speed responsive means for enabling the switch means when the first predetermined speed is exceeded by the motor and for disabling the switch mean when the motor speed falls below the first predetermined speed.

13. The apparatus of claim 12 wherein the switch control means is further responsive to an output from the first speed responsive means for disabling the switch means when the second predetermined speed is exceeded by the motor and for enabling the switch means when the speed of the motor below the second predetermined speed, the output of said first speed responsive means being controlled by said second speed responsive means after the motor speed exceeds the first predetermined speed.

14. Apparatus for controlling operations of a heating appliance employing an electrically controlled gas valve supplying a gas to be combusted within the appliance, the appliance having an exhaust system for removing combustion products and including a motor driven exhaust fan for inducing a draft within the exhaust system by which combustion products are exhausted from the appliance, the apparatus comprising:

means for sensing the rotational speed of the motor and for providing an output signal representative thereof, said motor operating over a range of rotational speeds;

switch means for opening and closing the gas valve as a function of motor speed; and, first and second speed responsive means for determining when the motor is operating within a predetermined range of speeds, said first speed responsive means determining when the motor exceeds a first predetermined speed, said second speed responsive means determining when the motor exceeds a second predetermined speed, said first speed responsive means opening the gas valve when the motor speed exceeds the first predetermined speed whereby the gas valve is open only when said motor speed is in a range between said first and second predetermined speeds, and operation of each of said first speed responsive means is controlled by said second speed responsive means, the first and second speed responsive means further including means compensating for the hysteresis effects within the appliance to thereby establish a band at each end of the motor speed range within which valve operation is controlled; and, means for monitoring operation of said sensing means and for closing said valve in the event of a sensing means failure, the sensing means providing an output signal comprising a stream of clock pulses an d the monitoring means including means for differentiating the clock pulses and providing an output which is a function of the sensed transitions in the clock pulses which occur so long as the sensing means is functioning but which do not occur if the sensing means has failed, and means responsive to the output of the differentiating means for providing a signal to the switch control means to disable the switch means when the output from the differentiating means indicates a sensing means failure.

* * * * *

UNITED STATES PATENT AND TRADEMARK OFFICE

CERTIFICATE OF CORRECTION

PATENT NO. : 5,222,888

DATED :June 29 , 1993

INVENTOR(S) : Jones et al.

It is certified that error appears in the above-indentified patent and that said Letters Patent is hereby corrected as shown below:

Column 12, line 36, delete "17" and insert therefor ---11---;

Column 2, line 12, delete "off" and insert therefor ---of---;

Column 2, line 13, delete "of" second occurrence and insert therefor ---off---;

Column 4, line 20, delete "S," and insert therefor ---$S_S$---;

Column 5, line 46, after "CFM" insert therefor ---∝---;

Column 5, line 59, after "P" insert therefor ---∝---;

Column 6, line 65, after "diminish" insert therefor ---.---;

Column 9, line 12, delete "11" and insert therefor ---11---;

Signed and Sealed this

Thirteenth Day of September, 1994

*Attest:*

*Attesting Officer*

Bruce Lehman

BRUCE LEHMAN

*Commissioner of Patents and Trademarks*